US010669787B2

(12) United States Patent
Song et al.

(10) Patent No.: US 10,669,787 B2
(45) Date of Patent: Jun. 2, 2020

(54) PUMP ROD CONNECTION

(71) Applicant: Schlumberger Technology Corporation, Sugar Land, TX (US)

(72) Inventors: Fei Song, Sugar Land, TX (US); Ke Ken Li, Missouri City, TX (US); LeMoyne Boyer, Sugar Land, TX (US); William Kevin Hall, Sugar Land, TX (US); Qingbin Liu, Katy, TX (US); Rajkumar Shanmugam Mathiravedu, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 494 days.

(21) Appl. No.: 15/373,793

(22) Filed: Dec. 9, 2016

(65) Prior Publication Data

US 2018/0163485 A1 Jun. 14, 2018

(51) Int. Cl.
*E21B 17/042* (2006.01)
*F04B 47/02* (2006.01)
*E21B 43/12* (2006.01)

(52) U.S. Cl.
CPC ..... *E21B 17/042* (2013.01); *F04B 47/026* (2013.01); *E21B 43/127* (2013.01)

(58) Field of Classification Search
CPC ..... F16L 15/001; F16L 15/006; F16L 15/06
USPC ..... 285/333, 334, 390
See application file for complete search history.

(56) References Cited

U.S. PATENT DOCUMENTS 1,703,232 A * 2/1929 Gunn ..... B21D 53/00 148/208
1,851,714 A * 3/1932 McCullough ..... E21B 17/0426 285/390
1,879,856 A * 9/1932 Peterson ..... E21B 17/042 285/333
2,909,380 A * 10/1959 Hoye ..... F16L 15/001 285/333
4,205,926 A * 6/1980 Carlson ..... E21B 17/00 166/68
4,549,754 A * 10/1985 Saunders ..... E21B 17/042 285/334
4,687,368 A * 8/1987 Eklof ..... E21B 17/0426 285/334
4,861,210 A * 8/1989 Frerejacques ..... F16B 33/02 411/411
4,905,760 A * 3/1990 Gray ..... B05D 1/24 166/105
5,794,985 A 8/1998 Mallis
6,212,763 B1 * 4/2001 Newman ..... B25B 21/002 173/180

(Continued)

FOREIGN PATENT DOCUMENTS

WO 2015191940 A1 12/2015

OTHER PUBLICATIONS

International Search Report and Written Opinion for corresponding PCT Application Serial No. PCT/US2017/059620, dated Feb. 14, 2018, 15 pages.

(Continued)

*Primary Examiner* — Aaron M Dunwoody

(57) ABSTRACT

A pump rod can include a body that includes a longitudinal axis; and a pin at an end of the body where the pin includes threads where the threads include tangential elliptical roots.

16 Claims, 11 Drawing Sheets

(56) References Cited

U.S. PATENT DOCUMENTS 6,447,025 B1 * 9/2002 Smith ..... E21B 17/042 285/333
6,467,818 B1 * 10/2002 Snapp ..... E21B 17/042 285/334
7,078,623 B1 7/2006 Sheehan
7,108,063 B2 * 9/2006 Carstensen ..... E21B 17/0426 166/241.2
7,210,710 B2 * 5/2007 Williamson ..... E21B 17/042 285/333
7,416,374 B2 * 8/2008 Breihan ..... F16B 33/02 285/334
7,596,847 B2 * 10/2009 Carstensen ..... E21B 17/0426 285/343
7,735,879 B2 6/2010 Toscano et al.
8,141,630 B2 * 3/2012 Pliska ..... E21B 17/042 166/105
9,494,182 B2 * 11/2016 Matsubayashi ..... F16B 39/30
9,611,694 B2 * 4/2017 Beronius ..... F16B 33/02
10,160,033 B2 * 12/2018 Singh ..... B21H 3/04
2003/0038476 A1 * 2/2003 Galle, Jr. ..... F16L 15/003 285/92
2003/0085570 A1 * 5/2003 Ernst ..... E21B 17/042 285/333
2004/0113427 A1 * 6/2004 Ernst ..... E21B 17/042 285/333
2006/0089976 A1 * 4/2006 Breihan ..... E21B 17/042 709/218
2006/0125234 A1 * 6/2006 Ernst ..... E21B 17/042 285/333
2006/0214421 A1 * 9/2006 Muradov ..... E21B 17/042 285/333
2006/0273601 A1 12/2006 Carstensen
2010/0123311 A1 5/2010 Church
2010/0140929 A1 * 6/2010 Nava ..... E21B 17/0426 285/333
2011/0168286 A1 * 7/2011 Koch ..... E21B 17/042 138/89
2013/0147191 A1 * 6/2013 Mazzaferro ..... E21B 17/042 285/390
2014/0129037 A1 5/2014 Peterson
2015/0354287 A1 * 12/2015 Nielsen ..... E21B 17/0426 166/105
2015/0362100 A1 * 12/2015 Li ..... F16L 15/06 285/390
2016/0032663 A1 * 2/2016 Benedict ..... E21B 17/042 285/333
2016/0215571 A1 * 7/2016 Muradov ..... E21B 17/042
2016/0298400 A1 * 10/2016 Sabatier ..... E21B 43/127
2017/0356252 A1 * 12/2017 Wollmann ..... E21B 17/1071
2018/0106399 A1 * 4/2018 Freed ..... E21B 17/042

OTHER PUBLICATIONS

American Petroleum Institute (API), "Specification for Sucker Rods, Polished Rods and Liners, Couplings, Sinker Bars, Polished Rod Clamps, Stuffing Boxes, and Pumping Trees", Specification 11B, 27th Edition, May 2010, 103 pages.
NACE International, "Standard Materials Requirements: Metals for Sulfide Stress Cracking an Stress Corrosion Cracking Resistance in Sour Oilfield Environments", 2003, 44 pages.
Tenaris, Sucker Rods Catalogue, Apr. 2012, 72 pages.

* cited by examiner

Method
900

910

920

930

940

PUMP ROD CONNECTION

BACKGROUND

Various types of equipment can be utilized in a subterranean environment. As an example, a pump such as a sucker rod pump can be utilized to move fluid in a well in a subterranean environment.

SUMMARY

A pump rod can include a body that includes a longitudinal axis; and a pin at an end of the body where the pin includes threads where the threads include tangential elliptical roots. A pump rod string can include rods where each rod includes a body that includes a longitudinal axis and a pin at an end of the body where the pin includes pin threads where the pin threads include tangential elliptical roots formed with rolling dies; and couplings where each of the couplings includes coupling threads that include tangential elliptical roots formed with forming taps and mate with the pin threads to form rod and coupling joints. Various other apparatuses, systems, methods, etc., are also disclosed.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

As an example, a system may be a pump system that includes one or more mechanisms to reciprocate a rod string where the rod string can include rods that are joined via couplings. For example, a rod can include opposing threaded ends, which may be referred to as pins, where each of the ends can be threaded into mating threads of a coupling. In such an example, a long rod string can be assembled that is made up of a series of rods where the rods are joined by couplings. Such a rod string may be meters in length.

As an example, a rod may be a sucker rod. A sucker rod can be a steel rod that is used to make up a mechanical assembly between the surface and downhole components of a rod pumping system. As an example, a sucker rod may be a non-standardized length or a standardized length. As an example, a standardized length of a sucker rod may be in a range from about 25 ft to about 30 ft (e.g., about 7 m to about 9 m).

As an example, a pumping system can be an artificial-lift pumping system that can be powered using a surface power source to drive a downhole pump assembly. As an example, a pumping system can include a beam and crank assembly that creates reciprocating motion in a rod string that connects to the downhole pump assembly. In such an example, the downhole pump assembly can include a plunger and valve sub-assembly that can convert reciprocating motion to vertical fluid movement.

As an example, an electric motor may be utilized to reciprocate a rod string, optionally via one or more belt or chain drives. For example, a belt driven pumping unit can include a belt that is coupled to a rod string for reciprocating the rod string vertically within a well as the belt is driven by an electric motor. As an example, a pump may be a sucker rod pump that includes a sucker rod string.

Figure 1:
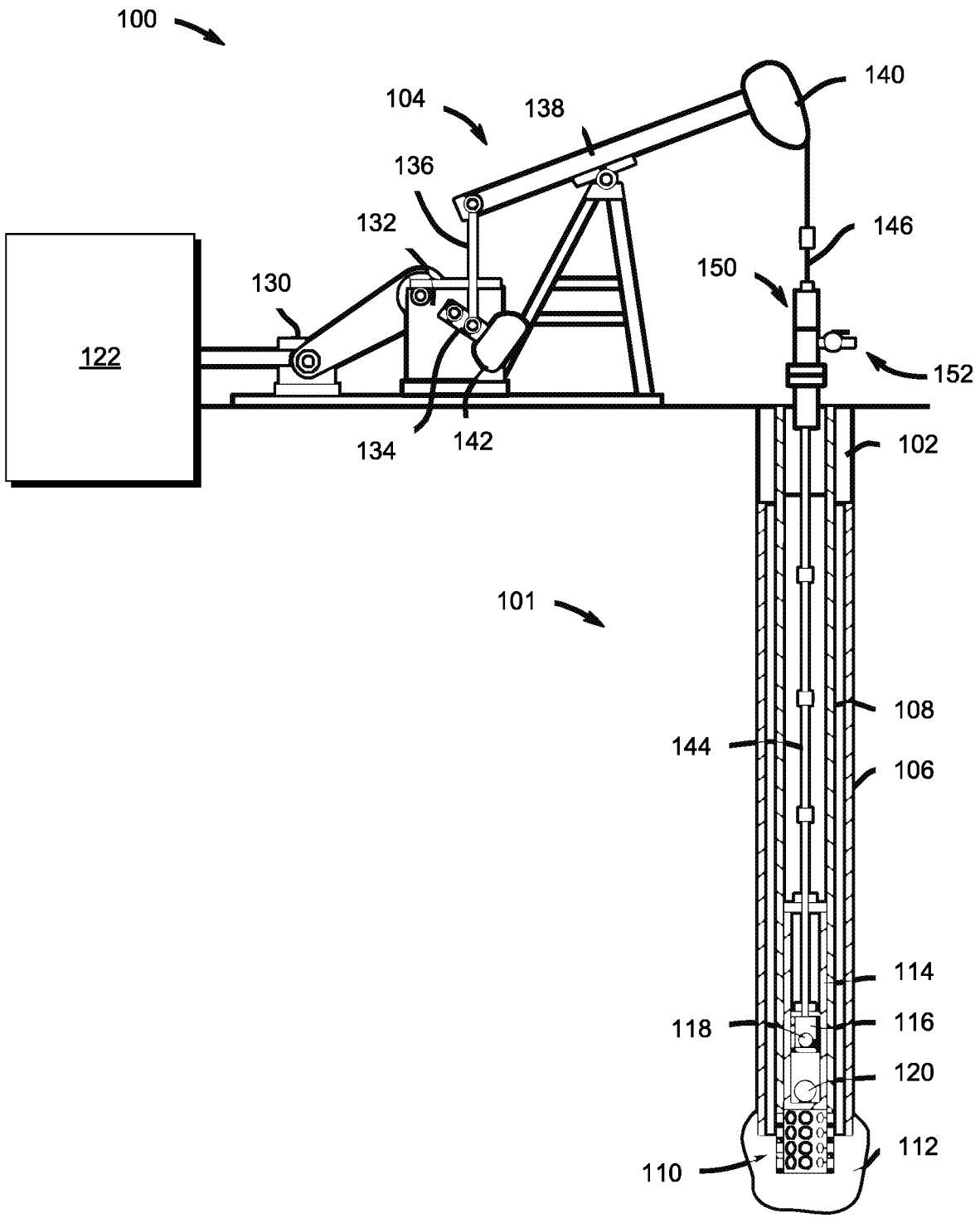
FIG. 1 illustrates an example of a system that includes a pump disposed in a subterranean environment.

FIG. 1 shows an example of a system 100 that includes a pump assembly 101 as driven by a pump drive system 104 that is operatively coupled to a controller 122. In the example of FIG. 1, the pump assembly 101 and drive system 104 are arranged as a beam pump. As shown in FIG. 1, a walking beam 138 reciprocates a rod string 144 that includes a polished rod portion 146 that can move in a bore of a stuffing box 150 of a well head assembly that includes a discharge port 152. The rod string 144 can be suspended from the walking beam 138 via a horse head 140 for actuating a downhole pump 110 of the pump assembly 101 where the downhole pump 110 is positioned in a well 102, for example, near a bottom 112 of the well 102.

A well in a subterranean environment may be a cased well or an open well or, for example, a partially cased well that can include an open well portion or portions. In the example of FIG. 1, the well 102 includes casing 106 that defines a cased bore where tubing 108 is disposed in the cased bore. As shown, an annular space can exist between an outer surface of the tubing 108 and an inner surface of the casing 106.

In the example of FIG. 1, the walking beam 138 is actuated by a pitman arm (or pitman arms) 136, which is reciprocated by a crank arm (or crank arms) 134 driven by an electric motor 130. As shown, the electric motor 130 can be coupled to the crank arm 134 through a gear reduction mechanism, such as gears of a gearbox 132. As an example, the electric motor 130 can be a three-phase AC induction motor that can be controlled via circuitry of the controller 122, which may be connected to a power supply. The gearbox 132 of the pump drive system 104 can convert electric motor torque to a low speed, high torque output for driving the crank arm 134. The crank arm 134 can be operatively coupled to a counterweight 142 that serves to balance the rod string 144 as suspended from the horse head 140 of the walking beam 138. A counterbalance may be provided by an air cylinder such as those found on air-balanced units.

The downhole pump 110 can be a reciprocating type pump that includes a plunger 116 attached to an end of the rod string 144 and a pump barrel 114, which may be attached to an end of the tubing 108 in the well 102. The plunger 116 can include a traveling valve 118 and a standing valve 120 positioned at or near a bottom of the pump barrel 114. During operation, for an up stroke where the rod string 144 translates upwardly, the traveling valve 118 can close and lift fluid (e.g., oil, water, etc.) above the plunger 116 to a top of the well 102 and the standing valve 120 can open to allow additional fluid from a reservoir to flow into the pump barrel 114. As to a down stroke where the rod string 144 translates downwardly, the traveling valve 118 can open and the standing valve 120 can close to prepare for a subsequent cycle. Operation of the downhole pump 110 may be controlled such that a fluid level is maintained in the pump barrel 114 where the fluid level can be sufficient to maintain the lower end of the rod string 144 in the fluid over its entire stroke.

Figure 2:
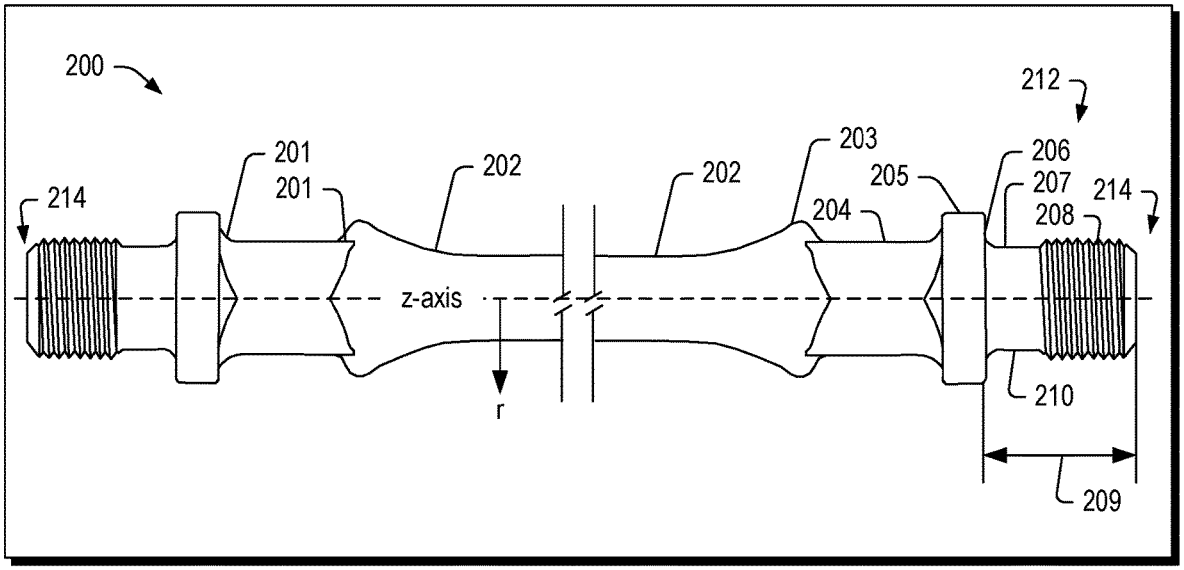
FIG. 2 illustrates an example of a pump rod and an example of a coupling.
Figure 2:
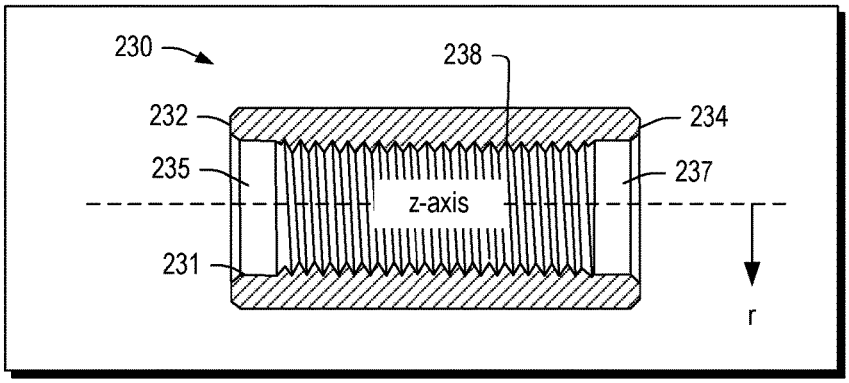
Figure 2:
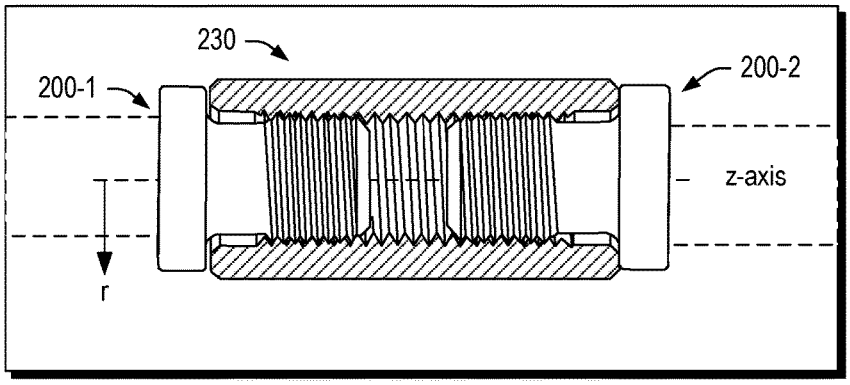

FIG. 2 shows an example of a rod 200 and an example of a coupling 230 that may be utilized in the rod string 144 of the pump system 110 of FIG. 1. FIG. 2 also shows an example of a first rod 200-1 and a second rod 200-2 joined to the coupling 230.

In the example of FIG. 2, the rod 200 is shown as including an optional shape transition portion 201, a rod body 202, an upset bead 203, a wrench square 204 (e.g., a flat, plate-like portion), a pin shoulder 205 (e.g., optionally annular in shape), an axial face 206, a stress relief portion 207, a thread portion 208, a pin length 209 and a stress relief length 210. In the example of FIG. 2, a pin 212 can be defined by the pin length 209, which can be measured as an axial distances along a longitudinal axis of the rod 200 from the axial face 206 to an end 214 of the rod 200; noting that in the example of FIG. 2, the rod 200 is symmetric as to its features about a plane that bisects the rod body. As an example, a rod may include a pin at one end and another feature at another end.

In FIG. 2, the coupling 230 includes a bore 231 that extends between opposing end 232 and 234 along with a thread portion 238 (e.g., or threaded portions) disposed between unthreaded regions 235 and 237. As an example, the pin 212 of the rod 200 can be threaded into the coupling 230 such that threads of the threaded portion 208 mate with a portion of threads of the threaded portion 238 of the coupling 230. As an example, two of the rods 200 may be joined to the coupling 230 where, for example, the pins 212 are threaded into the coupling 230 until the axial faces 206 contact respective ends 232 and 234 of the coupling 230. An approximated illustration of such an arrangement is shown in FIG. 2 for the first rod 200-1 and the second rod 200-2 as joined to the coupling 230 to form a portion of a rod string.

A rod may be formed according to one or more specifications. For example, per the API Specification 11B 27th edition (2010) ("Specification for Sucker Rods, Polished Rods and Liners, Couplings, Sinker Bars, Polished Rod Clamps, Stuffing Boxes, and Pumping Tees"), which is incorporated by reference herein, the threaded portion of sucker rod shouldered connections is to be ten threads per inch and conform to the unified thread form with Class 2A-2B tolerances and allowances, as defined in ANSI/ASME B1.1; the design profile of the pin thread is type UNR with rounded root contour; the thread profile of the box thread is type UN having a flat root contour with a permissible round root contour beyond the 0.25×pitch (0.25 p) flat width to allow for crest wear; sucker rod threads are to be straight threads where the thread form is to be complete over the designed length and not to include contain tears, ruptures, shears, holes or seams that are outside of the acceptance criteria as defined by a manufacturer's procedures.

Figure 3:
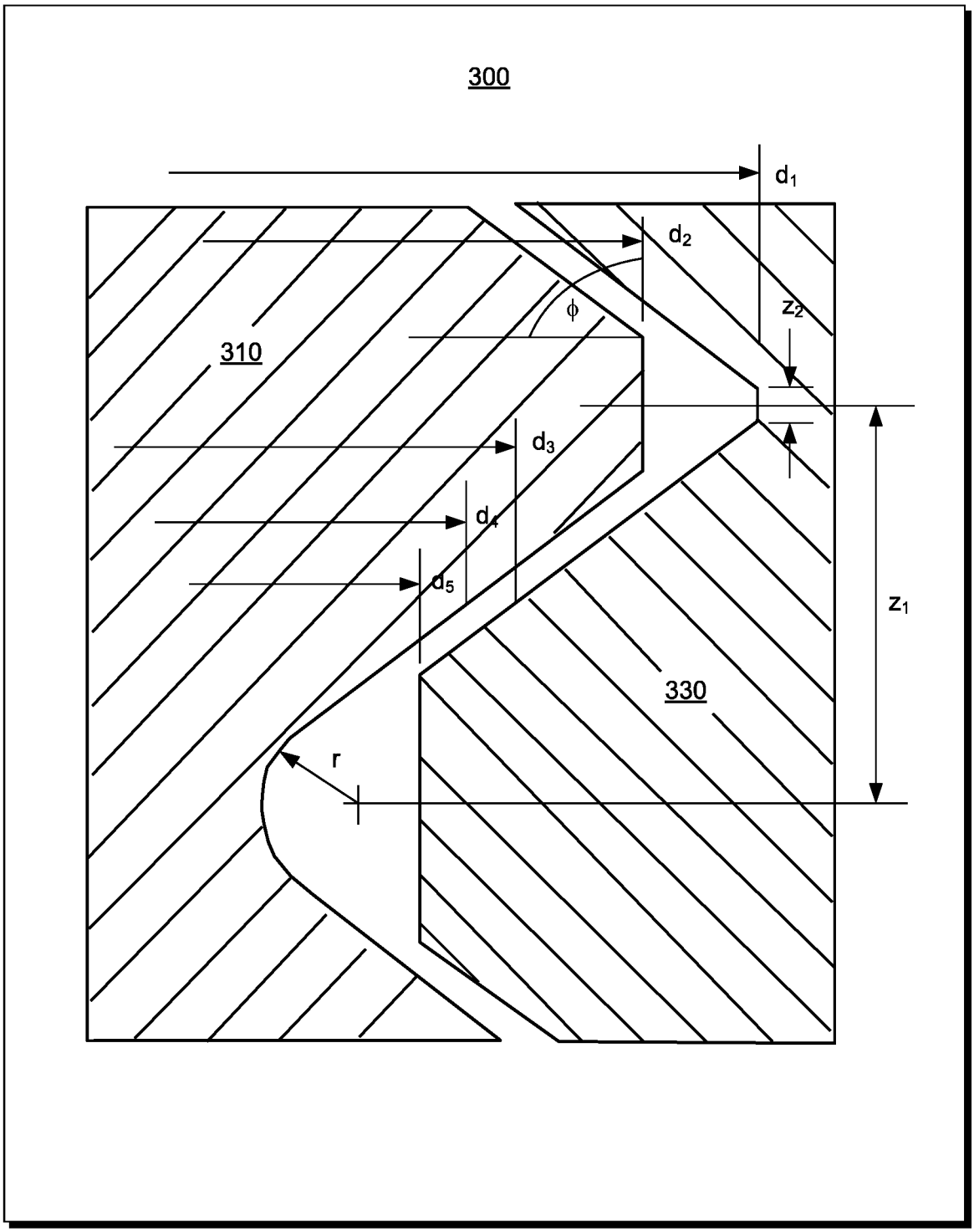
FIG. 3 illustrates a cross-sectional view of threads of a rod (e.g., a pin) and a coupling (e.g., a box)

FIG. 3 shows an arrangement 300 that includes a pin 310 and a coupling 330 (e.g., a box) that corresponds to the API ⅞ inch specification 11B for standard thread forms, which includes a curvature defined by a portion of a circle, tangentially adjoining two flanks of adjacent threads. Such a standard API connection has limited root radii with higher stress concentrations, which can be subject to fatigue, for example, during harsh operation with high cyclic strokes.

In FIG. 3, diameters $d_1$, $d_2$, $d_3$, $d_4$ and $d_5$ correspond to a maximum box major diameter, a minimum pin major diameter, a maximum box pitch diameter, a minimum box pitch diameter and a maximum box minor diameter, respectively. Axial dimensions $z_1$ and $z_2$ correspond to a box distance and an axial pitch length where the pitch can be at 10 threads per inch (e.g., per 2.54 cm). A radius, r, is shown as being associated with the minimum diameter of the pin. An angle, $\phi$, is shown as being associated with the threads of the pin 310, which can be specified to be 30 degrees.

With reference to FIG. 2, the API Specification 11B for a ⅞ inch steel suck rod or steel pony rod includes a thread diameter of 1.1875 inch (30.16 mm), a stress relief length of 0.672 inch (17.07 mm), a stress relief diameter of 1.040 inch (26.42 mm), a length of pin of 1.625 inch (41.28 mm).

As an example, a rod connection for a pin and a coupling (e.g., a box) can include a symmetric thread root design. Such a rod connection can be utilized for pins and couplings as in a rod pumping system used in oil and gas production.

A rod connection may be formed by a pin as a rod member and a box as a coupling member. Threads of the pin and the box can include a tangential elliptical root design with a selected root depth, and thread parameters such as pitch, equivalent root radius, and flank angles appropriately selected.

A stress relief groove (SRG), as a portion of a pin, can be dimensioned to achieve a minimum stress concentration, for example, such that the fatigue strength of a joint can be enhanced.

Numerical trials indicate that thread design can increase the rod connection life under harsh pumping operation. As an example, a trial demonstrated that a minimum of an about five fold increase in strength can be achieved when compared to standard API Specification 11B threads.

As an example, a method can include optimizing thread form parameters for improved fatigue strength of sucker rod connections under high cyclic axial and bending loads. For example, a connection can include threads with relatively larger pitch and relatively larger equivalent root radius, and relatively smaller flank angle than the API Specification 11B threaded sucker rod connections. In such an example, the connection can reduce stress concentration in the root and maintain shear resistance. As an example, a root portion can include a curvature defined by a portion of a symmetric ellipse, tangentially adjoining two flanks of adjacent threads.

Figure 4:
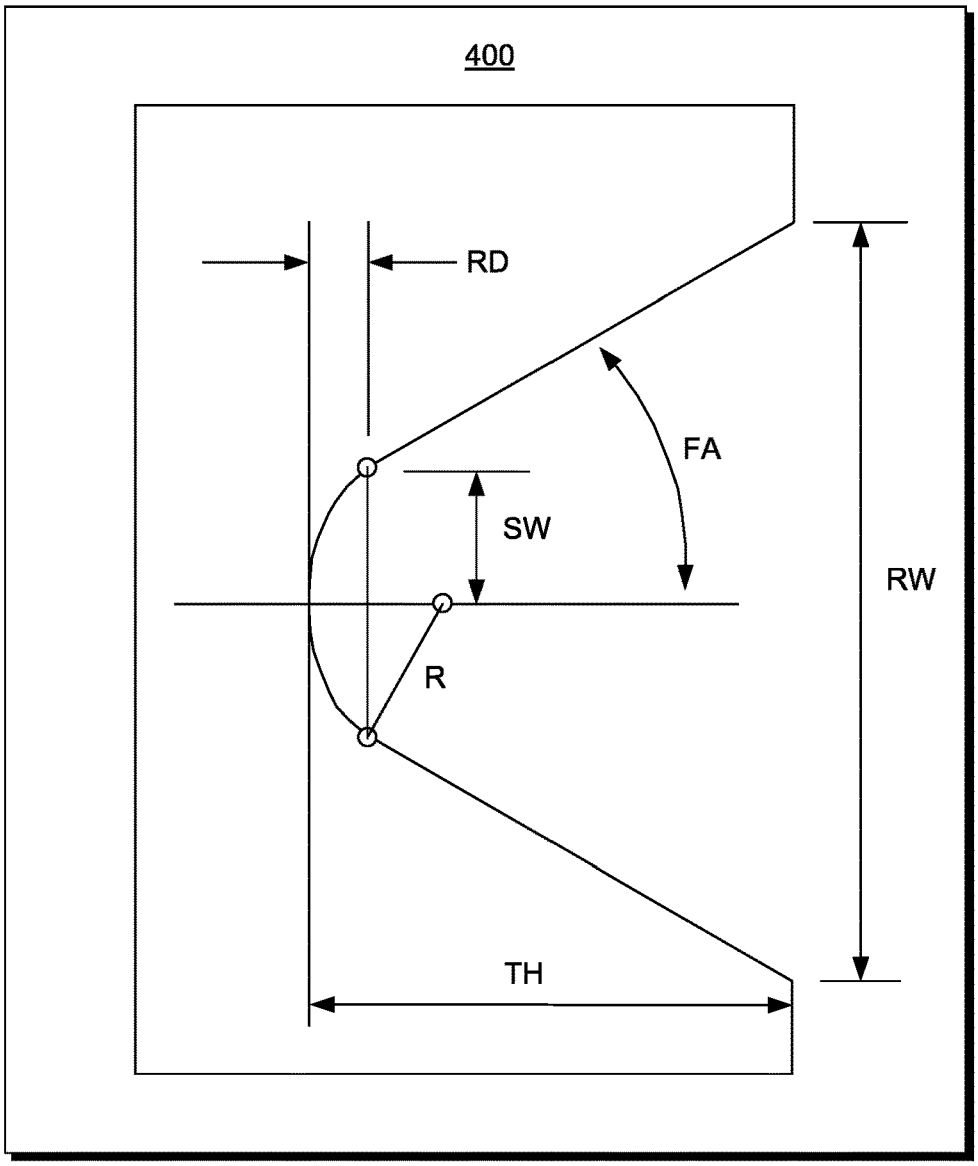
FIG. 4 illustrates a plot of a shape of threaded connection and thread root.
Figure 4:
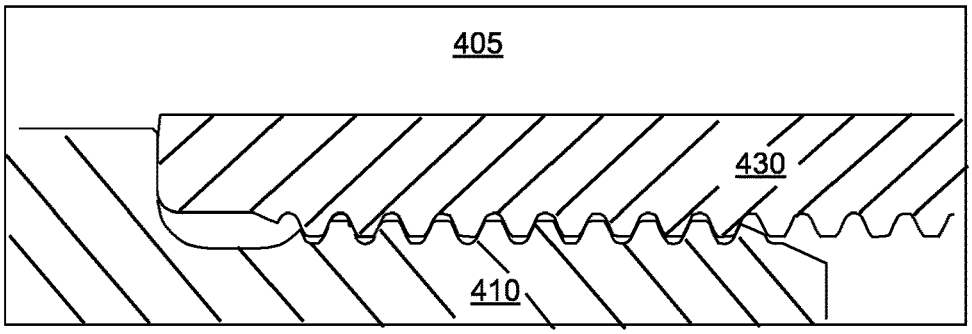

FIG. 4 shows an example of a diagram 400 of a tangential elliptical design that is symmetric where R is the equivalent root radius, FA is the flank angle, SW is the root semi-width at the flank transition point, RW is the root width at the crest, TH is the truncated thread height, RD is the root depth between the flank transition point and the root bottom. In the example of FIG. 4, various equations can relate features. For example, SW=R cos(FA); RW=(Pitch−Crest width); and TH=[RW/2−R cos(FA)]/tan(FA)+RD.

FIG. 4 also shows an example of a joint 405 that includes a pin 410 (e.g., a pin of a rod) and a box 430 (e.g., a box of a coupling). In the joint 405, the threads can be defined using parameters such as one or more of the parameters illustrated in the diagram 400. During installation, use and/or removal of a rod string in a bore of a well, which may be a bore of casing, the joint 405 can come into contact with well fluid. For example, well fluid may enter a clearance between a rod and a coupling and come into contact with threads.

As shown in the example of FIG. 4, for a given SW, the root depth (RD) can be optimized, such that the peak stress is kept in the middle of the root with the manufacturing tolerances considered.

Figure 5:
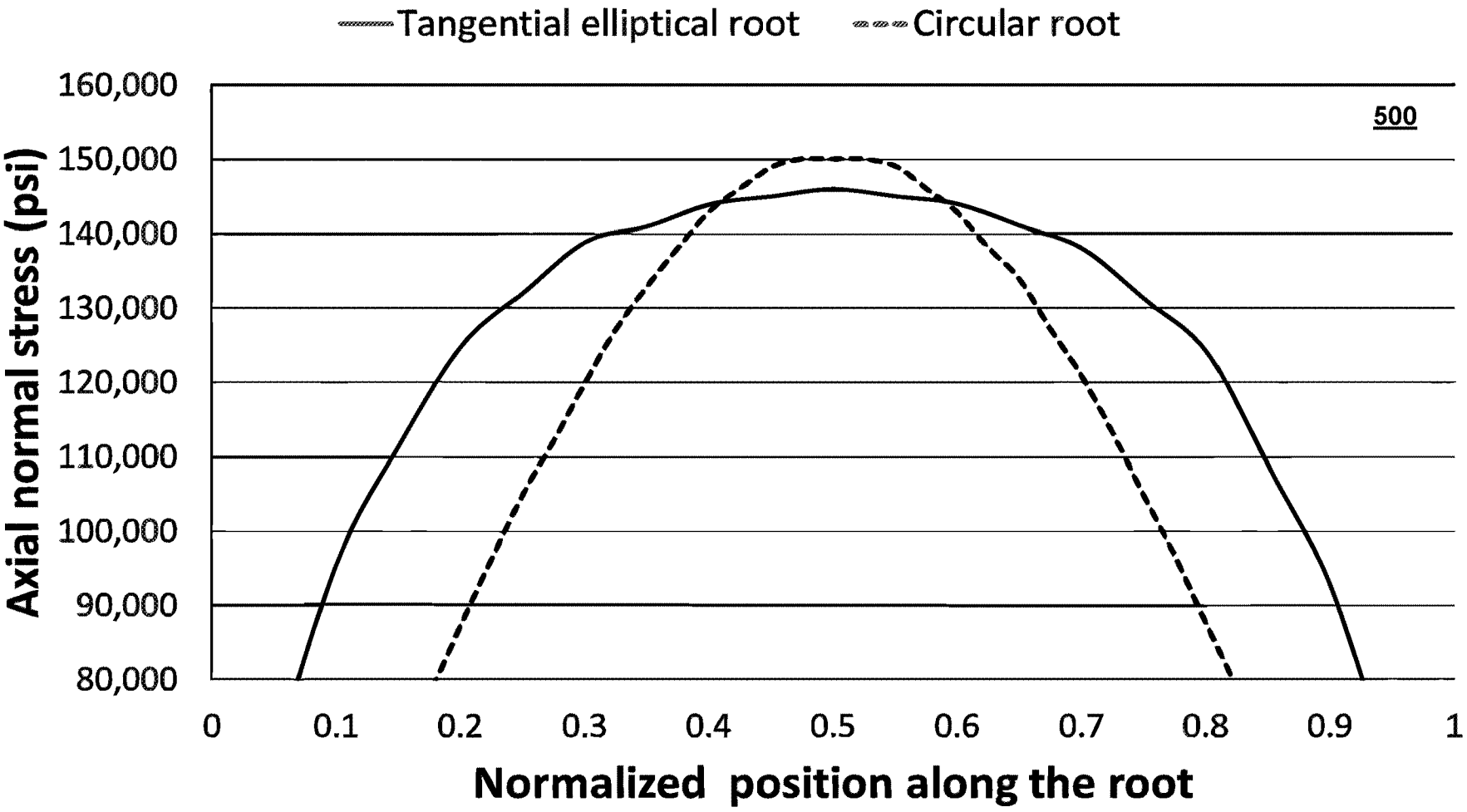
FIG. 5 illustrates an example of a plot of numerical analyses of axial normal stress versus normalized position along a thread root.

FIG. 5 shows an example plot 500 of axial normal stress versus normalized position along the root, as corresponding to the diagram 400 of FIG. 4. The plot 500 shows a reduced peak stress on the optimized tangential elliptical root used in an example ⅞ inch design as compared to a circular root.

Figure 6:
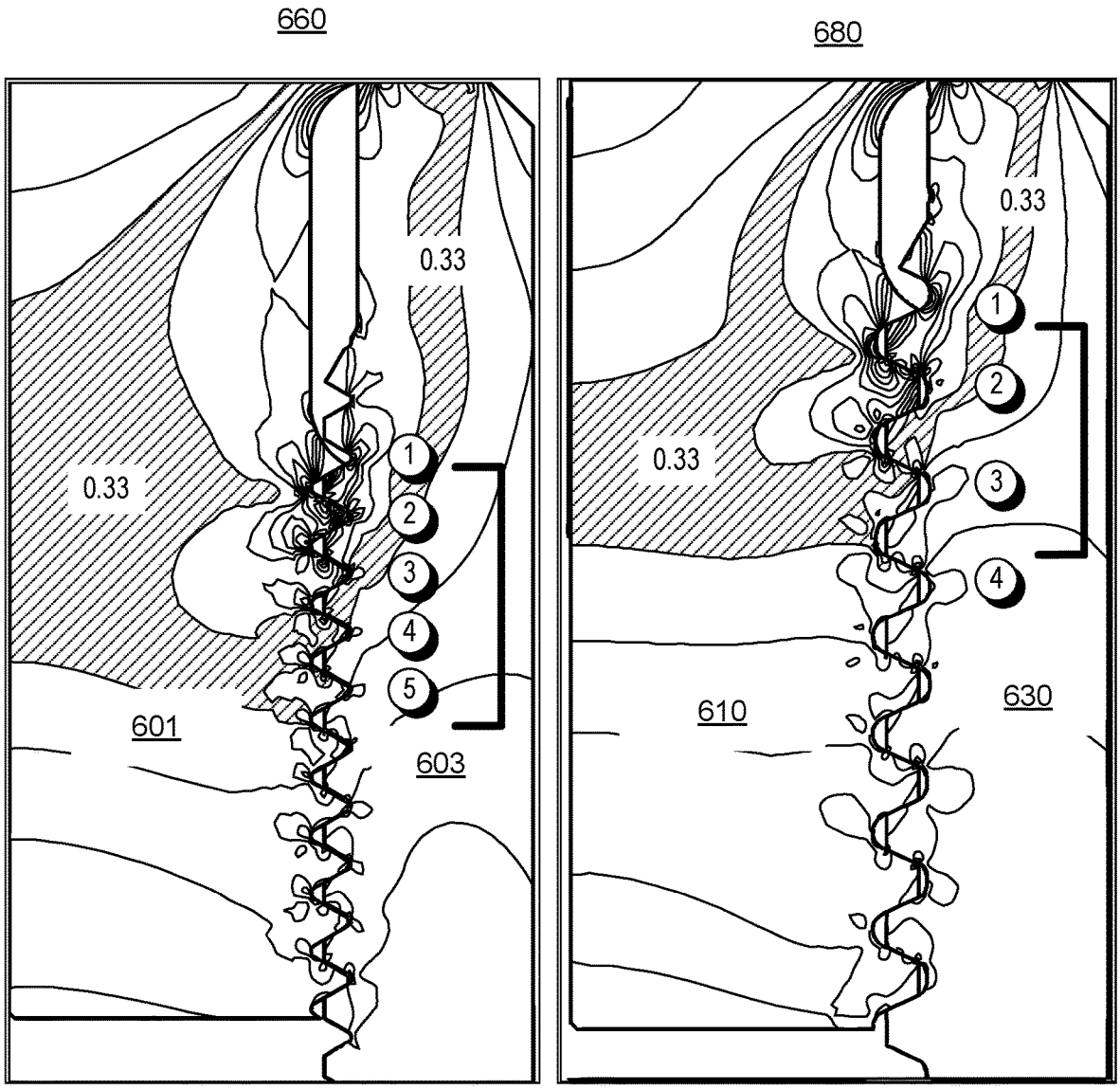
FIG. 6 illustrates example plots of numerical analyses of normalized equivalent stress for a rod-coupling threaded connection.

FIG. 6 shows example plots 660 and 680 from numerical trials using finite element analysis (FEA, via ABAQUS software package, Dassault Systemes, Waltham, Mass.) for a connection made of a pin 601 and a box 603 (see the plot 660) and for a connection made of a pin 610 and a box 630 (see the plot 680). The plots 660 and 680 provide a comparison of normalized equivalent stress in ⅞ inch API Specification 11B threads (see the plot 660) and in ⅞ inch "AT" design threads (see the plot 680) after makeup torque has been applied.

In the plots 660 and 680, normalized stress (normalized von Mises stress) is shown as contours where contour regions are labeled for 0.33. Labels are also included for thread counts. As shown in the plot 660, the contour region labeled 0.33 for the pin 601 extends over an axial length of about five (5) thread counts; whereas, as shown in the plot 680, the contour region labeled 0.33 for the pin 610 extends over an axial length of about three (3) thread counts. The results in the plots 660 and 680 demonstrate a reduction in normalized stress for the connection threads of the pin 610 and the box 630 compared to the connection threads of the pin 601 and the box 603. The results in the plots 660 and 680 demonstrate a tensile/shear capacity for the connection threads of the pin 610 and the box 630 as being on par with the standard API Specification 11B ⅞ inch sucker rod connection.

As an example, a method can include roll-forming threads on a pin upon machining of a stress relief groove (SRG) on the pin. A SRG of a pin can be a possible region of risk, for example, a potential weak link of a joint. As an example, a method can include optimizing an SRG of a pin to achieve a minimum stress concentration. In such an example, the minimum stress concentration can aim to increase fatigue resistance of a threaded joint.

Figure 7:
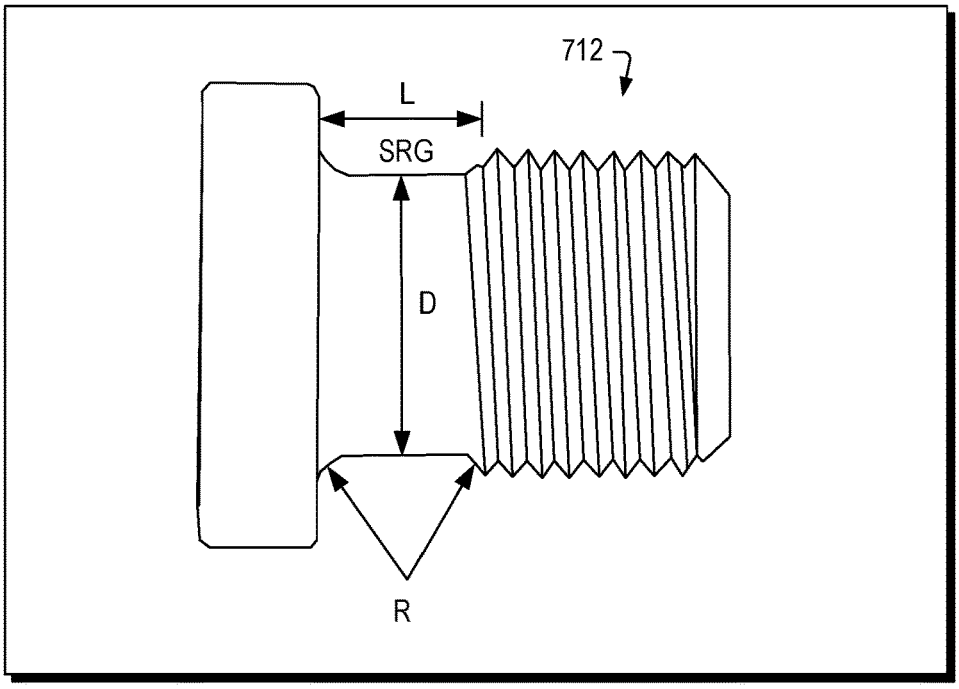
FIG. 7 illustrates an example of a rod connection and an example plot of SCF versus pin SRG length.
Figure 7:
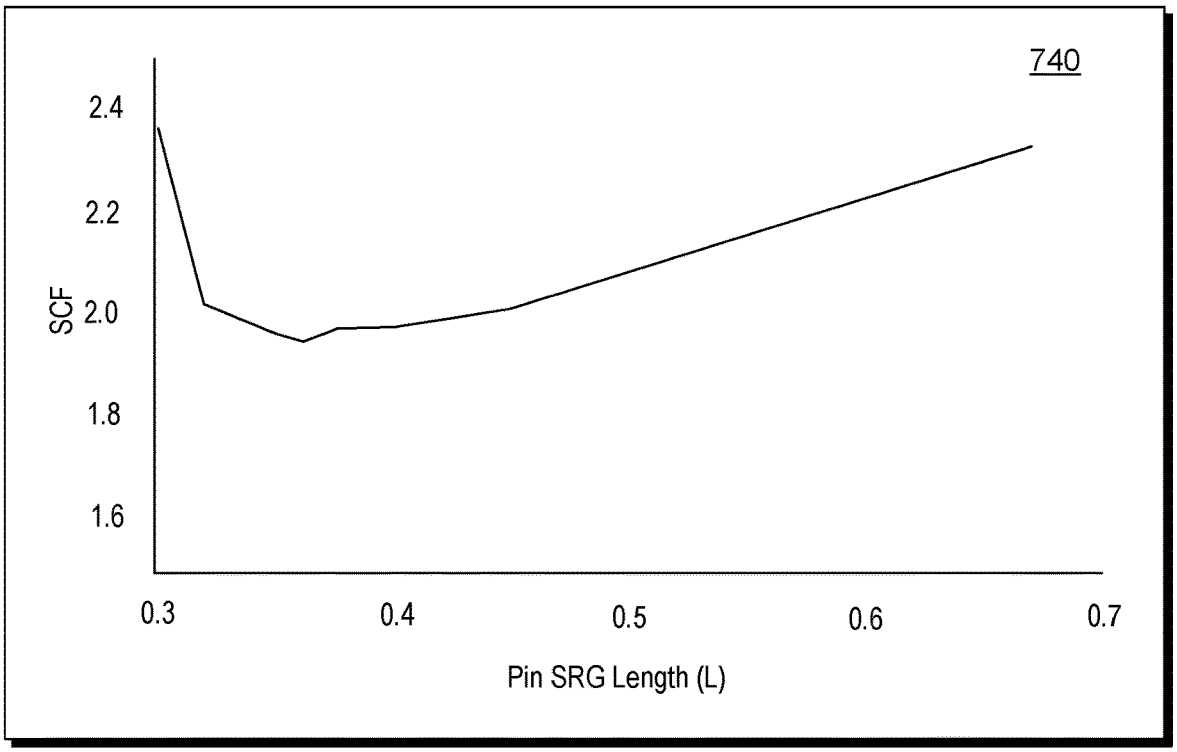

FIG. 7 shows an example of a pin 712 along with an example plot 740. As shown, the pin 712 includes a stress relief groove (SRG) with a diameter D and an approximate axial length L, where portions of the SRG may be defined by one or more radii (e.g., to avoid sharp corners or sharp shoulders). The plot 740 shows stress concentration factor (SCF) versus pin SRG length (L). As shown, data of the plot 740 indicates that a minimum in SCF exists between about 0.325 L to about 0.375 L where the minimum in SCF is less than about 2.

As an example, a pin can include a root shape defined by various parameters. Table 1, below, shows some examples of parameters and parameter values.

TABLE 1

Examples of Parameters and Values

| Example Root Shape | |
|---|---|
| SW | 0.0199" to 0.0272" (0.0505 cm to 0.0691 cm) |
| Pitch (TPI) | ⅛" to ⅙" (0.3175 cm to 0.4233 cm) |
| Equivalent Root Radius | 0.022" to 0.03" (0.05588 cm to 0.0762 cm) |
| Flank Angle | 25 degrees to 30 degrees |
| Crest Width | 0.0425" to 0.056" (0.1079 cm to 0.1422 cm) |
| Root Depth | 0.009" to 0.012" (0.0229 cm to 0.0305 cm) |
| Taper (TPF) | 0 to 1.25 inch per foot (0 to 10.4 cm per m) |
| SRG Length | 0.32" to 0.42" (0.8128 cm to 1.067 cm) |

Table 1 provides a summary of some examples of primary thread parameters, which may be referenced to, for example, the diagram 400 of FIG. 4, which shows a tangential elliptical root design that is symmetric. As mentioned, such a design can reduce peak stress, as shown in the plot 500 of FIG. 5, which shows a comparison of a tangential elliptical root and a circular root. As an example, a flank angle can be less than 30 degrees.

As an example, a pin of a rod can include threads that include a root shape defined by one or more root shape parameters. As an example, a root depth can be a root shape parameter that, for a ⅞ inch rod, can be a value in range from approximately 0.009 inch to approximately 0.012 inch (e.g., approximately 0.0229 cm to approximately 0.0305 cm). As an example, root semi-width at the flank transition point (SW) can be a root shape parameter that, for a ⅞ inch rod, can be a value in a range from approximately 0.0199 inch to approximately 0.0272 inch (e.g., approximately 0.0505 cm to approximately 0.0691 cm). As an example, root depth and SW can be selected to define stress concentration in a pin of a rod in a rod string that includes couplings that couple rods.

As an example, a method can include utilizing the API Specification 11B ⅞ inch sucker rod connection as a baseline design.

As an example, a connection that includes a pin and a box (e.g., a coupling), mating threads may be characterized by: a tangential elliptical root design with equivalent root radius in a range from about 0.022 inch to about 0.030 inch (e.g., approximately 0.05588 cm to approximately 0.0762 cm) and a root depth in a range from about 0.009 inch to about 0.012 inch (e.g., approximately 0.0229 cm to approximately 0.0305 cm); a single-start helix; a pitch in a range from about ⅛ inch to about ⅙ inch (e.g., approximately 0.3175 cm to approximately 0.4233 cm), a taper in a range from about 0 to about 1.25 inch per foot (e.g., approximately 0 to approximately 10.4 cm per m), a flank angle in a range from about 25 degrees to about 30 degrees; a life enhancement minimum of about 5.0 (per connection FEA); a SRG length in a range from about 0.32 inch to about 0.42 inch (e.g., approximately 0.8128 cm to approximately 1.067 cm); an on par tensile and shear capacity to the baseline design; and acceptable non-interchangeability.

As an example, a rod and/or a coupling can be made of one or more types of steel. A type of steel can be a carbon steel, alloy steel (e.g., a low alloy steel, a high alloy steel, etc.) or another type of steel. As an example, a rod and/or a coupling can be made of one or more types of fiber materials. For example, a fiber material can be a fiberglass material, a carbon fiber material or another type of fiber material. As an example, a rod and/or a coupling can be made of a nickel alloy, a cooper alloy, etc.

As an example, a pin of a rod can be made of a metal alloy where during use in a rod string, the pin may be in a relatively normalized stress state (e.g., lower stress concentration), which can allow for enhanced performance in a sour gas environment (e.g., through reduced risk of stress corrosion cracking (SCC)).

As an example, a rod (e.g., a rod pin) and a coupling (e.g., a coupling box) can include threads are cold formed with rolling dies and forming taps, respectively. Such a rod and a coupling can be of one or more standard and/or non-standard rod/coupling sizes.

Figure 8:
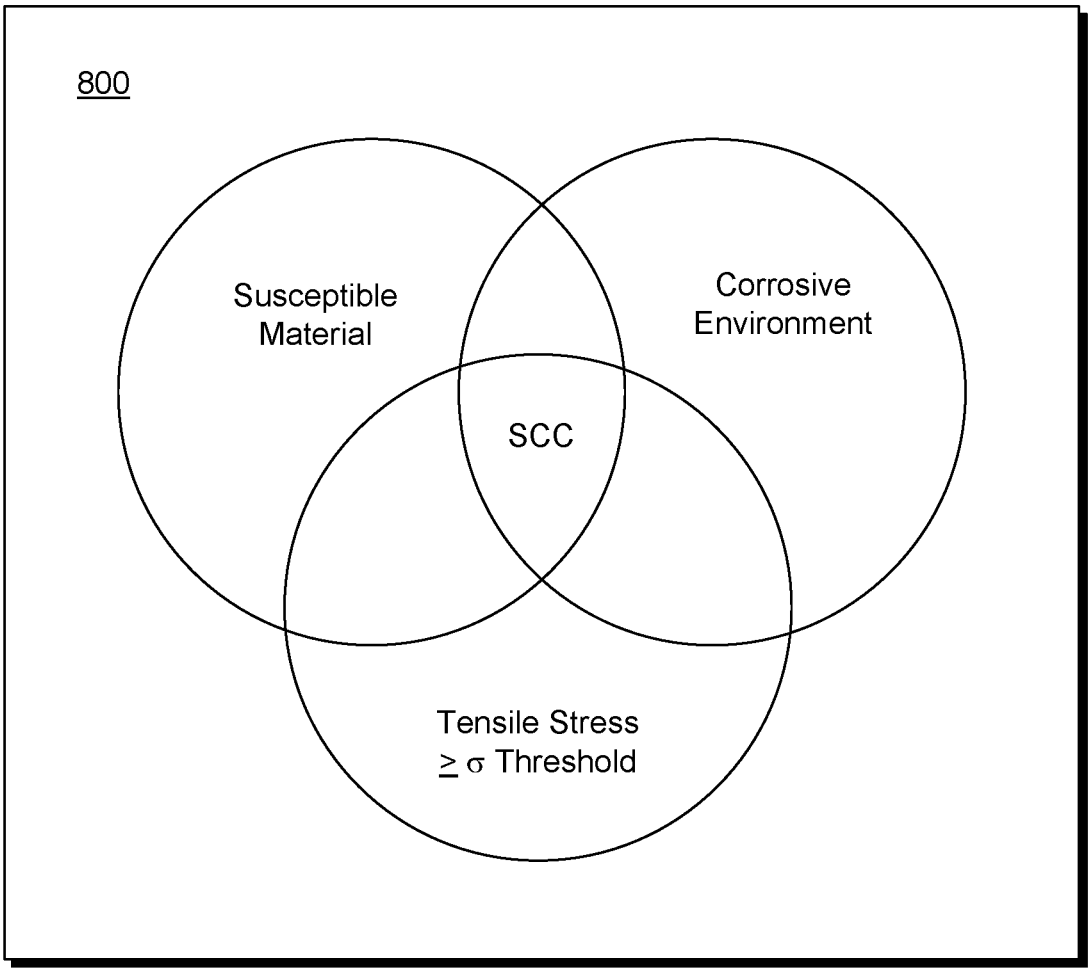
FIG. 8 illustrates an example plot of some factors associated with stress corrosion cracking (SCC)

FIG. 8 shows a diagram 800 that illustrates stress corrosion cracking (SCC), which is a type of corrosion process (e.g., a degradation process). As shown, SCC may occur given a susceptible material, a corrosive environment and a tensile stress that is greater than or equal to a stress threshold. In terms of temporal aspects, the three conditions represented in the Venn type of diagram 800 may occur simultaneously to promote SCC. SCC can cause a material or part to fail at a stress level below a material-rated yield strength (e.g., a frangible degradation mechanism).

SCC involves growth of crack formation in a corrosive environment and can lead to unexpected sudden failure of normally ductile metals subjected to a tensile stress, particularly at elevated temperature. SCC can be highly chemically specific in that certain alloys are likely to undergo SCC when exposed to a small number of chemical environments. The chemical environment that causes SCC for a given alloy is often one which is mildly corrosive to the metal otherwise. Hence, metal parts with severe SCC can appear bright and shiny, while being filled with microscopic cracks. SCC may progress rapidly. Stresses can be the result of the crevice loads due to stress concentration, or can be caused by the type of assembly or residual stresses from fabrication (e.g. cold working). As an example, in some instances, residual stresses can be relieved at least in part by annealing and/or one or more other types of surface treatments.

As an example, a material or alloy can be susceptible to SCC (e.g., stronger or harder the material, the more susceptible to fracture providing the environment is conducive to SCC). As an example, an environment amenable to SCC may include one or more corrosive substances (e.g., halides like chlorides, etc.) and may be of a temperature that promotes kinetics, thermodynamics and/or mechanical degradation (e.g., expansion, different thermal conductivities, etc.). As an example, the more corrosive the conditions and the more likely fracture may occur as a result of imposed tensile stresses. As to tensile stresses, the greater the tensile stresses, the sooner a fracture or fractures may develop; further, below a certain threshold, cracking may not occur unless the environment or materials are made more amenable to stress-corrosion cracking.

As mentioned, during installation, use and/or removal of a rod string in a bore of a well, which may be a bore of casing, a joint can come into contact with well fluid. For example, well fluid may enter a clearance between a rod and a coupling and come into contact with threads. As an example, sour gas may contact threads. In such an example, the threads may be in a sour gas environment (e.g., in an environment that includes sour gas).

Sour gas can be a term that characterizes gases that are acidic either alone or when associated with water. Two examples of sour gases associated with oil and gas drilling and production are hydrogen sulfide, $H_2S$, and carbon dioxide, $CO_2$. Sulfur oxides and nitrogen oxides, generated by oxidation of certain sulfur- or nitrogen-bearing materials, can be in such a category but tend not to be found in anaerobic subsurface conditions.

Figure 9:
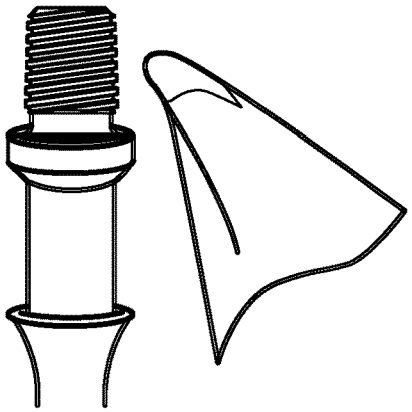
FIG. 9 illustrates an example of a method.
Figure 9:
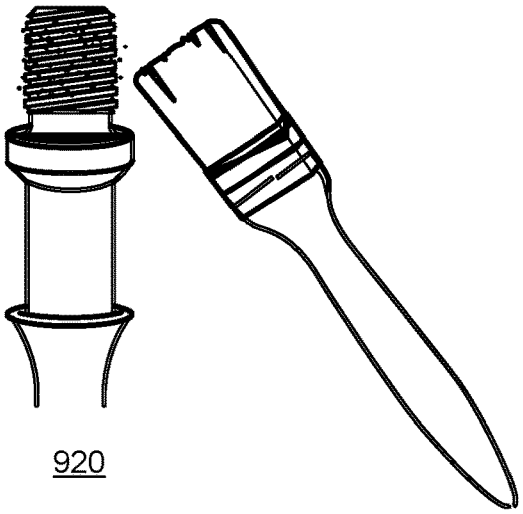
Figure 9:
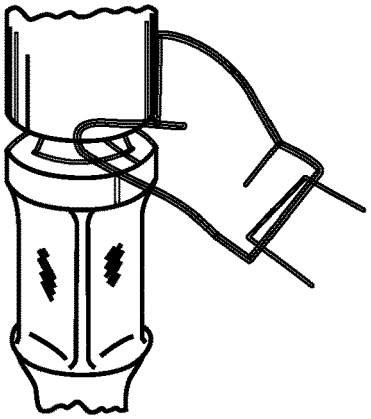
Figure 9:
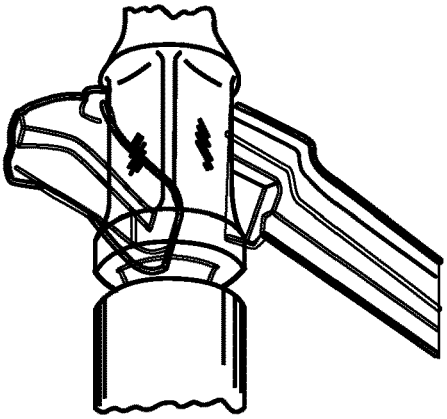

FIG. 9 shows an example of a method 900 that includes a clean process 910 for cleaning a pin with solvent and/or detergent and optionally drying with pressurized gas, an application process 920 for applying a dope compound (e.g., API 5A3) to the pin, a buck process 930 for bucking a coupling on the pin until at least one set of threads are engaged, and a hoist process 940 for hoisting up and furthering the connection to engage additional sets of threads, which can include using a tool such as a wrench. Such a method may include pressure process for applying pressure with power tongs until flank to flank contact occurs and, for example, a torque process for applying torque until a desired amount of torque is achieved. A method may include checking circumferential displacement, which may utilize a gauge (e.g., a card, a tool, etc.).

The method 900 can include utilizing a pin such as a pin with tangential elliptical root threads and the method 900 can include using a coupling with tangential elliptical root threads.

Figure 10:
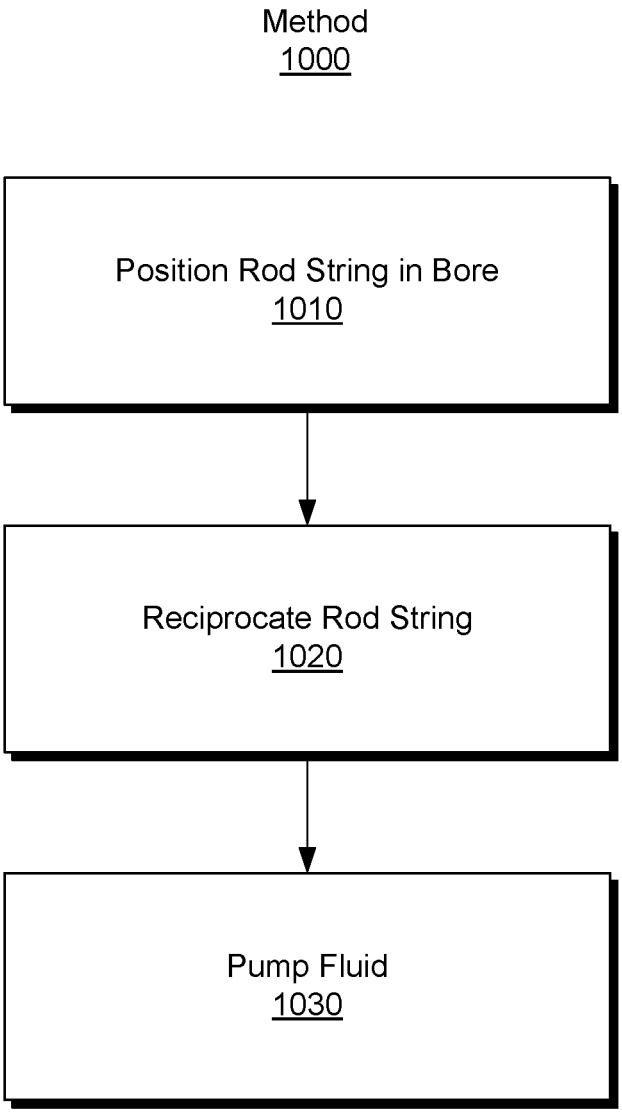
FIG. 10 illustrates an example of a method.

FIG. 10 shows an example of a method 1000 that includes a position block 1010 for positioning a rod string in a bore, a reciprocate block 1020 for reciprocating the rod string in the bore, and a pump block 1030 for pumping fluid via a pump operatively coupled to the rod string.

The method 1000 can include utilizing rods with pins such as pins with tangential elliptical root threads. The method 1000 can include utilizing couplings with tangential elliptical root threads.

Figure 11:
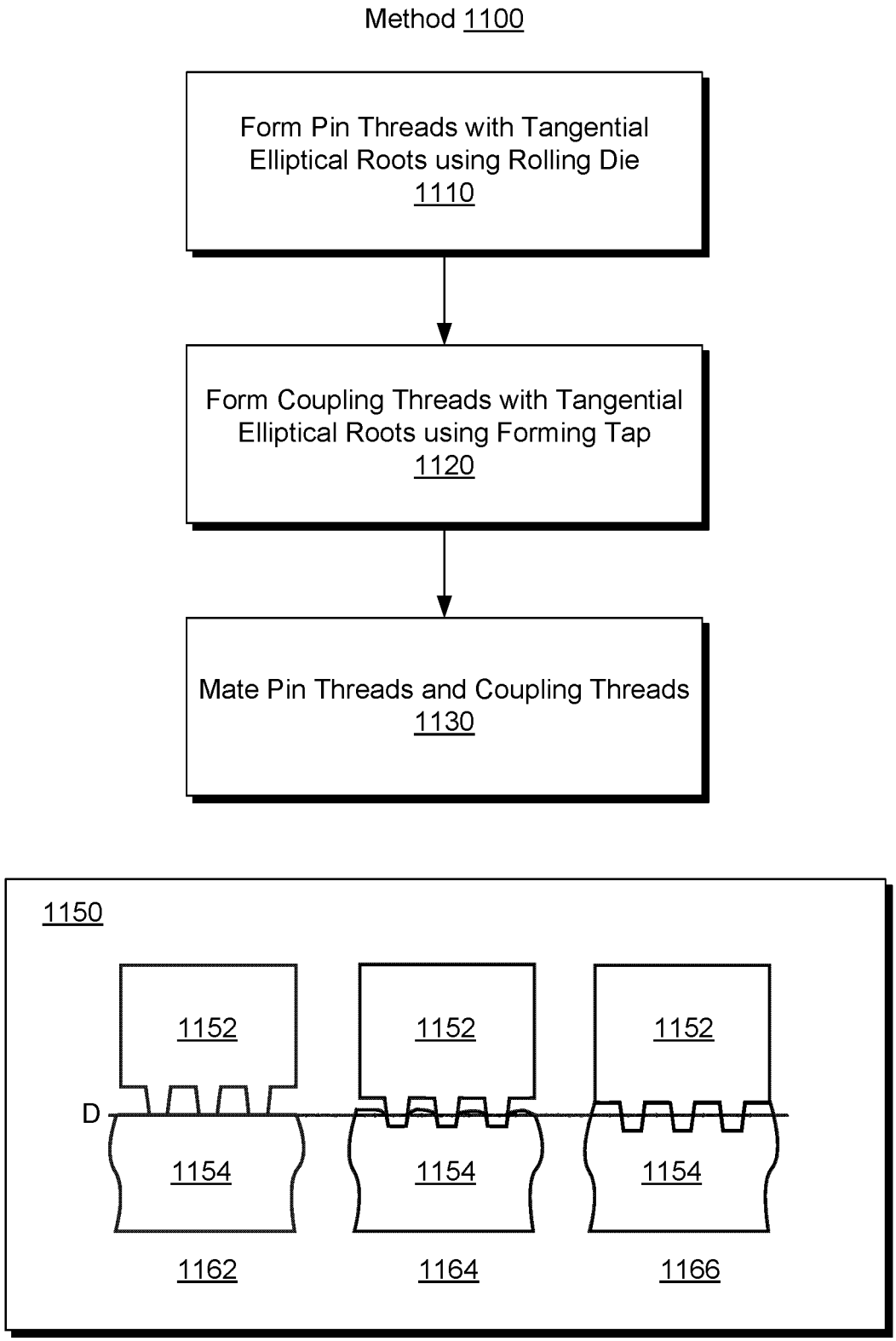
FIG. 11 illustrates an example of a method.

FIG. 11 shows an example of a method 1100 that includes a formation block 1110 for forming pin threads with tangential elliptical roots using a rolling die, a formation block 1120 for forming coupling threads with tangential elliptical roots using a forming tap, and a mate block 1130 for mating the pin threads and the coupling threads to connect two or more components, which can include one or more rods and one or more couplings. FIG. 11 also shows an approximate diagram of processes 1150 that can create threads using a tool 1152 in a workpiece 1154. As shown with respect to a contacting process 1162, the tool 1152 and the workpiece 1154 can be brought into contact at an outer diameter D of the workpiece 1154. A force application process 1164 can force a portion of the tool 1152 into the material of the workpiece 1154 (e.g., penetration of workpiece 1154 by a portion of the tool 1152). As shown, in a formation process 1166, threads can be formed in the workpiece 1154 by the tool 1152. The diagram of the processes 1150 pertains to concepts of how thread forming and rolling processes may be performed using a tool (e.g., a die, a tap, etc.) and a workpiece (e.g., a rod, a pin, a coupling, etc.).

Thread forming and thread rolling are processes that can form threads. Thread forming can form internal threads and thread rolling can form external threads. As an example, a thread rolling process can form threads in a blank piece of material (e.g., stock material, material formed as a component, etc.) by pressing a shaped tool such as a thread rolling die against the blank. As an example, a thread forming may be performed using a forming tap, which may be, for example, a fluteless forming tap, a roll forming tap or another type of forming tap. A forming tap can include lobes spaced around the tap that provide for thread forming as the tap is advanced into a properly sized hole (e.g., advanced axially along an axis).

Forming and rolling may be performed where no swarf is generated and, for example, where less material is utilized because a blank size can start smaller than a blank utilized in a process that involves cutting threads. A rolled thread can be of a larger diameter than a blank pin (e.g., a blank rod or portion thereof) from which it has been made. As an example, one or more necks and/or one or more undercuts may be cut or rolled onto a blank with threads that are not rolled.

As an example, a pump rod can include a body that includes a longitudinal axis; and a pin at an end of the body where the pin includes threads where the threads include tangential elliptical roots. In such an example, the tangential elliptical roots can be defined at least in part by a root semi-width at flank transition point parameter (SW). In such an example, the root semi-width at flank transition point parameter has a value in a range from approximately 0.0199 inch to approximately 0.0272 inch (e.g., approximately 0.0505 cm to approximately 0.0691 cm).

As an example, tangential elliptical roots can be defined at least in part by a root depth parameter. In such an example, a root depth parameter can have a value in a range from approximately 0.009 inch to approximately 0.012 inch (e.g., approximately 0.0229 cm to approximately 0.0305 cm).

As an example, tangential elliptical roots can be defined at least in part by an equivalent root radius. In such an example, an equivalent root radius parameter can have a value in a range from approximately 0.022 inch to approximately 0.03 inch (e.g., approximately 0.05588 cm to approximately 0.0762 cm).

As an example, tangential elliptical roots can be defined at least in part by a pitch parameter. In such an example, a pitch parameter can have a value in a range from approximately ⅛ inch to approximately ⅙ inch (e.g., approximately 0.3175 cm to approximately 0.4233 cm).

As an example, tangential elliptical roots can be defined at least in part by a flank angle parameter. In such an example, the flank angle parameter can have a value in a range from approximately 25 degrees to approximately 30 degrees.

As an example, tangential elliptical roots can be defined at least in part by a root width at crest parameter. In such an example, a root width at crest parameter can have a value in a range from approximately 0.0425 inch to approximately 0.056 inch (e.g., approximately 0.1079 cm to approximately 0.1422 cm)

As an example, a pin can include a stress relief groove portion. In such an example, a stress relief groove portion can have an axial length that is in a range from approximately 0.32 inch to approximately 0.42 inch (e.g., approximately 0.8128 cm to approximately 1.067 cm).

As an example, a pump rod can be a sucker rod of a sucker rod pump. As an example, a pump rod can be coupled to a coupling where the coupling is threaded to a pin of the pump rod.

As an example, a pump rod string can include rods where each rod includes a body that has a longitudinal axis and a pin at an end of the body where the pin includes pin threads where the pin threads include tangential elliptical roots formed with rolling dies; and couplings where each of the couplings includes coupling threads that include tangential elliptical roots formed with forming taps and mate with the pin threads to form rod and coupling joints. In such an example, the pump rod string can include well fluid where the well fluid is in contact with at least some of the pin threads. As an example, such well fluid can include sour gas. As an example, the tangential elliptical roots of the pin threads can be less susceptible to stress corrosion cracking (SCC) due to the shape of the roots reducing stress in the presence of the well fluid that includes sour gas.

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A pump rod comprising:

a body that comprises a longitudinal axis; and a pin at an end of the body wherein the pin comprises threads wherein the threads comprise tangential elliptical roots, wherein the tangential elliptical roots are defined by an equivalent root radius parameter having a value in a range from approximately 0.022 inch to approximately 0.03 inch.

2. The pump rod of claim 1 wherein the tangential elliptical roots are defined by a root semi-width at a flank transition point parameter (SW).

3. The pump rod of claim 2 wherein the root semi-width at flank transition point parameter has a value in a range from approximately 0.0199 inch to approximately 0.0272 inch.

4. The pump rod of claim 1 wherein the tangential elliptical roots are defined by a root depth parameter.

5. The pump rod of claim 4 wherein the root depth parameter has a value in a range from approximately 0.009 inch to approximately 0.012 inch.

6. The pump rod of claim 1 wherein the tangential elliptical roots are defined by a pitch parameter.

7. The pump rod of claim 6 wherein the pitch parameter has a value in a range from approximately ⅛ inch to approximately ⅙ inch.

8. The pump rod of claim 1 wherein the tangential elliptical roots are defined by a flank angle parameter.

9. The pump rod of claim 8 wherein the flank angle parameter has a value in a range from approximately 25 degrees to approximately 30 degrees.

10. The pump rod of claim 1 wherein the tangential elliptical roots are defined by a root width at crest parameter.

11. The pump rod of claim 10 wherein the root width at crest parameter has a value in a range from approximately 0.0425 inch to approximately 0.056 inch.

12. The pump rod of claim 1 wherein the pin comprises a stress relief groove portion.

13. The pump rod of claim 12 wherein the stress relief groove portion comprises an axial length that is in a range from approximately 0.32 inch to approximately 0.42 inch.

14. The pump rod of claim 1 wherein the rod comprises a sucker rod of a sucker rod pump.

15. The pump rod of claim 1 comprising a coupling threaded to the pin.

16. A pump rod string comprising:

rods wherein each rod comprises a body that comprises a longitudinal axis and a pin at an end of the body wherein the pin comprises pin threads wherein the pin threads comprise tangential elliptical roots formed with rolling dies; and couplings wherein each of the couplings comprises coupling threads that comprise tangential elliptical roots formed with forming taps and mate with the pin threads to form rod and coupling joints, wherein the tangential elliptical roots are defined by a root depth parameter having a value in a range from approximately 0.009 inch to approximately 0.012 inch.

* * * * *